US012571145B2

(12) United States Patent
Pei-Ting

(10) Patent No.: US 12,571,145 B2
(45) Date of Patent: Mar. 10, 2026

(54) OUTER LAYER STRUCTURE OF A STUFFED OBJECT AND A SEWING METHOD THEREOF

(71) Applicant: Chung Pei-Ting, Taipei City (TW)

(72) Inventor: Chung Pei-Ting, Taipei City (TW)

(73) Assignee: Chung Pei-Ting

( * ) Notice: Subject to any disclaimer, the term of this patent is extended or adjusted under 35 U.S.C. 154(b) by 761 days.

(21) Appl. No.: 17/584,423

(22) Filed: Jan. 26, 2022

(65) Prior Publication Data

US 2023/0093532 A1 Mar. 23, 2023

(30) Foreign Application Priority Data

Sep. 17, 2021 (CN) ..... 202111093578.2

(51) Int. Cl.
*D05B 93/00* (2006.01)
*D05B 1/12* (2006.01)
*D05B 13/00* (2006.01)

(52) U.S. Cl.
CPC ..... *D05B 93/00* (2013.01); *D05B 1/12* (2013.01); *D05B 13/00* (2013.01)

(58) Field of Classification Search
CPC . D05B 1/12; D05B 93/00; A63H 3/02; A63H 9/00
USPC ..... 112/424–426, 440–441; 446/369
See application file for complete search history.

(56) References Cited

U.S. PATENT DOCUMENTS 6,109,196 A * 8/2000 Silber ..... A63H 3/02 112/475.08
2002/0119728 A1* 8/2002 Block ..... A63H 3/02 446/369
2009/0071411 A1* 3/2009 Sacra ..... A01K 15/025 29/592

OTHER PUBLICATIONS

Double Invisible Stitch; "#81 Doppelte Zaubernaht (das Original), doppelter Matratzen-/Leiterstich—double invisible stitch"; congabaeren; https://www.youtube.com/watch?v=btAcLrsPvhA; Jun. 4, 2016.*

* cited by examiner

*Primary Examiner* — Nathan E Durham
(74) *Attorney, Agent, or Firm* — Amin, Turocy & Watson, LLP

(57) ABSTRACT

The present invention provides an outer layer structure of a stuffed object, comprising a first fabric component and a second fabric component fastened to each other substantially to form a container; a first stitching thread extended from a first end of an opening of the container to a second end of the opening so a first edge and a second edge of the container corresponds to each other and the opening is stitched and fastened by the first stitching thread, and thereby a first seam is formed at the opening; a second stitching thread extended from a first end of a third edge or a first end of a fourth edge of the first seam to a second end of a third edge or a second end of a fourth edge so the third edge and the fourth edge correspond and are fastened to each other to form a second seam. The present invention also provides a sewing method for a stuffed object with the outer layer structure.

20 Claims, 6 Drawing Sheets

OUTER LAYER STRUCTURE OF A STUFFED OBJECT AND A SEWING METHOD THEREOF

RELATED APPLICATIONS

The present application claims the priority of Chinese Application No. 202111093578.2, filed Sep. 17, 2021, the disclosure of which is hereby incorporated by reference herein in its entirety.

BACKGROUND OF THE INVENTION

1. Field of the Invention

The present invention relates to a sewing technology, and, more particularly, to an outer layer structure for increasing the strength at a stitching position of a stuffed object and a sewing method of the outer layer structure.

2. Description of the Related Art

For common stuffed objects, such as stuffed toys, the outer layers are made of cloths, artificial fibers or leather. A predetermined shape (such as various animals, plants or insects) is made by sewing the outer layer and an accommodation space for fillers is reserved inside the outer layer. The accommodation space can be filled by fillers, such as piles, foamed plastic particles or other particles. The outer layer is supported by the fillers so the stuffed toy would be more three-dimensional and its tactility would be better.

However, in the sewing technology, there is generally only one process to stitch two or more pieces of outer layers of stuffed toys together. No matter by machine sewing or hand sewing, there are certain limitations on the sewing strength. Therefore, after using the stuffed toy for a period of time, seam slippages or broken stitches would occur at the position with weaker seam, which results in an open seam and the fillers inside would be dropping out. If the open seams are not repaired properly, the function and quality of the stuffed toy would be greatly reduced and the resource of that is also wasted.

Besides, the stuffed toys have various usages. In addition to being entertaining for humans, they can also entertain pets. For example, the stuffed toys for dogs usually don't have a long service life because of the dog's dentition structure and the powerful biting force. Once the stuffed toys are torn and cannot be repaired, they must be discarded. That is not economical or environmental friendly.

Therefore, how to provide a technology for increasing the strength at the stitching positions of the stuffed object to enhance the durability has become an urgent problem to be solved in the industry.

SUMMARY OF THE INVENTION

The purpose of the present invention is to provide a technology for increasing the strength at the stitching positions of the stuffed object to enhance the durability.

In light of solving the foregoing problems of the prior art, the present invention provides an outer layer structure of a stuffed object, comprising: at least one first fabric component and at least one second fabric component fastened to each other substantially to form a container which has an accommodation space inside the container and a predetermined shape is defined by an outer surface of the container; the container further comprises an opening connected with the accommodation space, wherein the opening comprises: a first edge located on a side of the first fabric component and having a first end and a second end; and a second edge located on a side of the second fabric component and having a first end and a second end, and the second edge corresponds to the first edge to form the opening, wherein the opening has a first end and a second end; wherein the first end of the first edge corresponds to the first end of the second edge and the first end of the opening is formed by fastening the first end of the first edge to the first end of the second edge, and the second end of the first edge corresponds to the second end of the second edge and the second end of the opening is formed by fastening the second end of the first edge to the second end of the second edge; a first stitching thread extended from the first end of the opening to the second end of the opening so the first edge and the second edge corresponds to each other and the opening is stitched and fastened by the first stitching thread, and thereby a first seam is formed at the opening, wherein the first seam comprises: a third edge located on the first fabric component near the first edge and having a first end and a second end; and a fourth edge located on the second fabric component near the second edge and having a first end and a second end, and the fourth edge corresponds to the third edge, wherein the first end of the third edge corresponds to the first end of the fourth edge, and the first end of the third edge and the first end of the fourth edge are fastened to each other, and the second end of the third edge corresponds to the second end of the fourth edge, and the second end of the third edge and the second end of the fourth edge are fastened to each other; and a second stitching thread extended from the first end of the third edge or the first end of the fourth edge to the second end of the third edge or the second end of the fourth edge so the third edge corresponds to the fourth edge, and the third edge and the fourth edge are stitched and fastened to each other to form a second seam.

In an embodiment, the first edge comprises an n-th inputting needle point and an n-th outputting needle point, wherein n is a positive integer greater than 0, and the second edge comprises an m-th inputting needle point and an m-th outputting needle point, wherein m is a positive integer greater than 0, wherein when n is equal to m, the n-th inputting needle point of the first edge corresponds to the m-th outputting needle point of the second edge and the m-th inputting needle point of the second edge corresponds to the n-th outputting needle point of the first edge.

In an embodiment, the n-th inputting needle point and the n-th outputting needle point of the first edge are interlaced and intervallic arranged with each other, wherein n is a positive integer greater than 0 and a first inputting needle point of the first edge is near the first end of the first edge.

In an embodiment, the m-th inputting needle point and the m-th outputting needle point of the second edge are interlaced and intervallic arranged with each other, wherein m is a positive integer greater than 0 and a first outputting needle point of the second edge is near the first end of the second edge.

In an embodiment, the first stitching thread sequentially draws through the first inputting needle point of the first edge, the first outputting needle point of the second edge, the first inputting needle point of the second edge, the first outputting needle point of the first edge, the second inputting needle point of the first edge, the second outputting needle point of the second edge, the second inputting needle point of the second edge, the second outputting needle point of the first edge, . . . , the n-th inputting needle point of the first edge, the m-th outputting needle point of the second edge, the m-th inputting needle point of the second edge, the n-th outputting needle point of the first edge, wherein n is a positive integer greater than 2 and m is a positive integer greater than 2.

In an embodiment, the third edge comprises a p-th inputting needle point and a p-th outputting needle point, wherein p is a positive integer greater than 0, and the fourth edge comprises a q-th inputting needle point and a q-th outputting needle point, wherein q is a positive integer greater than 0, wherein when p is equal to q, the p-th outputting needle point of the third edge corresponds to the q-th inputting needle point of the fourth edge and the q-th outputting needle point of the fourth edge corresponds to the (p+1)-th inputting needle point of the third edge.

In an embodiment, the p-th inputting needle point and the p-th outputting needle point of the third edge are interlaced and intervallic arranged with each other, wherein p is a positive integer greater than 0 and a first inputting needle point of the third edge is near the first end of the third edge.

In an embodiment, the q-th inputting needle point and the q-th outputting needle point of the fourth edge are interlaced and intervallic arranged with each other, wherein q is a positive integer greater than 0 and a first inputting needle point of the fourth edge is near the first end of the fourth edge.

In an embodiment, the second stitching thread sequentially draws through the first inputting needle point of the third edge, the first outputting needle point of the third edge, the first inputting needle point of the fourth edge, the first outputting needle point of the fourth edge, the second inputting needle point of the third edge, the second outputting needle point of the third edge, the second inputting needle point of the fourth edge, the second outputting needle point of the fourth edge, . . . , the p-th outputting needle point of the third edge, wherein p is a positive integer greater than 2.

In an embodiment, after the second stitching thread sequentially draws through the p-th outputting needle point of the third edge, the second stitching thread draws through the q-th inputting needle point of the fourth edge, and then draws through the q-th outputting needle point of the fourth edge, wherein p is a positive integer greater than 2 and q is a positive integer greater than 2.

In an embodiment, the third edge comprises a p-th inputting needle point and a p-th outputting needle point, wherein p is a positive integer greater than 0, and the fourth edge comprises a q-th inputting needle point and a q-th outputting needle point, wherein q is a positive integer greater than 0, wherein when p is equal to q, the p-th inputting needle point of the third edge corresponds to the q-th outputting needle point of the fourth edge and the q-th inputting needle point of the fourth edge corresponds to the p-th outputting needle point of the third edge.

In an embodiment, the p-th inputting needle point and the p-th outputting needle point of the third edge are interlaced and intervallic arranged with each other, wherein p is a positive integer greater than 0 and a first inputting needle point of the third edge is near the first end of the third edge.

In an embodiment, the q-th inputting needle point and the q-th outputting needle point of the fourth edge are interlaced and intervallic arranged with each other, wherein q is a positive integer greater than 0 and a first outputting needle point of the fourth edge is near the first end of the fourth edge.

In an embodiment, the second stitching thread sequentially draws through the first inputting needle point of the third edge, the first outputting needle point of the fourth edge, the first inputting needle point of the fourth edge, the first outputting needle point of the third edge, the second inputting needle point of the third edge, the second outputting needle point of the fourth edge, the second inputting needle point of the fourth edge, the second outputting needle point of the third edge, . . . , the p-th inputting needle point of the third edge, the q-th outputting needle point of the fourth edge, the q-th inputting needle point of the fourth edge, the p-th outputting needle point of the third edge, wherein p is a positive integer greater than 2 and q is a positive integer greater than 2.

In an embodiment, the second stitching thread further forms a bar-tack structure between the first outputting needle point of the fourth edge and the first inputting needle point of the fourth edge.

In an embodiment, the vertical distance between the first stitching thread and the first edge or the second edge is between 1 mm and 5 mm.

In an embodiment, the vertical distance between the second stitching thread and the third edge or the fourth edge is between 1 mm and 5 mm.

In an embodiment, the distance between the n-th inputting needle point of the first edge and the n-th outputting needle point of the first edge is between 1 mm and 5 mm.

In an embodiment, the distance between the m-th inputting needle point of the second edge and the m-th outputting needle point of the second edge is between 1 mm and 5 mm.

In light of solving the foregoing problems of the prior art, the present invention provides a sewing method of an outer layer structure of a stuffed object, comprising: sewing partially along a periphery of at least one first fabric component and a periphery of at least one second fabric component to form a container which has an accommodation space inside the container; forming an opening at a unsewn portion between the periphery of the at least one first fabric component and the periphery of the at least one second fabric component, wherein the opening is connected with the accommodation space and the opening comprises a first edge and a second edge, wherein the first edge is located on a side of the first fabric component and has a first end and a second end; and the second edge is located on a side of the second fabric component and has a first end and a second end, and the second edge corresponds to the first edge to form the opening, wherein the opening has a first end and a second end; extending a first stitching thread from the first end of the opening to the second end of the opening so the first edge and the second edge corresponds to each other and the opening is stitched and fastened to form a first seam at the opening, wherein the first seam comprises a third edge and a fourth edge, wherein the third edge is located on the first fabric component near the first edge and has a first end and a second end, wherein the third edge is substantially parallel to the first edge; and the fourth edge is located on the second fabric component near the second edge and has a first end and a second end, wherein the fourth edge is substantially parallel to the second edge and the fourth edge corresponds to the third edge; and extending a second stitching thread from the first end of the third edge or the first end of the fourth edge to the second end of the third edge or the second end of the fourth edge so the third edge corresponds to the fourth edge, and the third edge and the fourth edge are stitched and fastened to each other to form a second seam.

Compared to the prior art, the stuffed object made by using the outer layer structure of the stuffed object and the sewing method thereof according to the present invention are able to increase the strength at the stitching positions of the stuffed object to enhance the durability of the stuffed object. In addition to being entertaining for humans, the stuffed object applying the present invention are more suitable for pets, such as dogs or cats, based on the great tolerance of biting and pulling.

DETAILED DESCRIPTION

The present invention is described by the following specific embodiments. Those with ordinary skills in the arts can readily understand other advantages and functions of the present invention after reading the disclosure of this specification.

The structures, scales and sizes showed in the appended drawings of the present invention are only used to illustrate with the disclosure of this specification for those with ordinary skills in the arts, and not restrictive of the scope of the present invention so they do not represent the substantial technical implication. Any modifications of the structures, changes of the scales or the adjustments of the sizes, without affecting the effects and goals achieved by the present invention, are construed as within the scope of technical content disclose by the present invention. The terms, such as on, inside, outside, bottom and one, in this specification are only to describe conveniently for clarify, and not restrictive of the scope of the present invention. Any changes or adjustments made to their relative relationships, without modifying the substantial technical contents, are also to be construed as within the range implementable by the present invention.

An outer layer structure of the stuffed object and a sewing method thereof according to the present invention could be applied to stuffed toys. More specifically, various materials or textile materials could be used for the outer layers of the stuffed toys. An accommodation space is formed inside the outer layer and can be filled by fluffy items, such as piles, cotton flock or artificial fibers so the stuffed toy is three-dimensional and has a fluffy and soft tactility. The outer layer structure of the stuffed object according to the present invention is not limited to be used for the stuffed toys. It is also suitable for the sewing structure modification on other stuffed objects.

Figure 1:
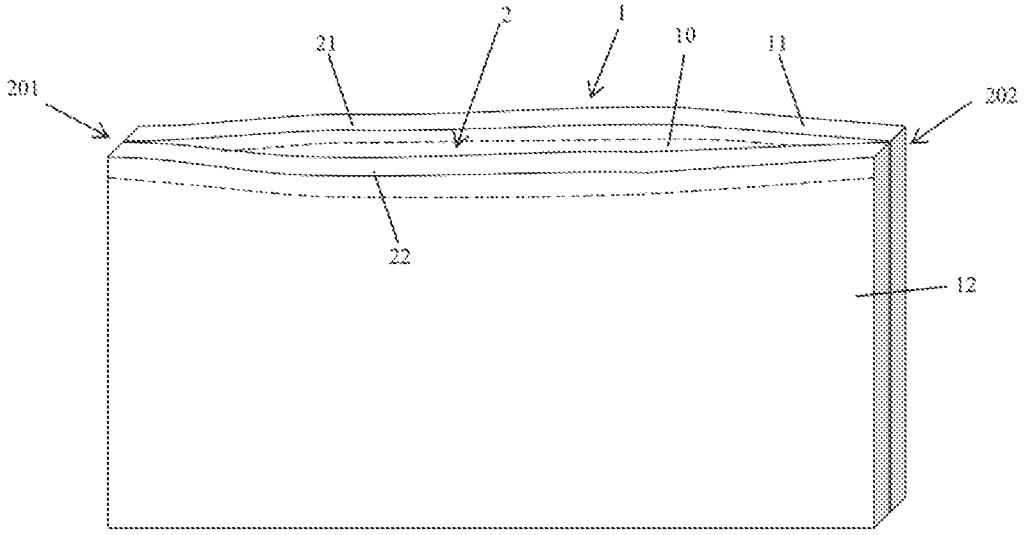
FIG. 1 illustrates a structural schematic view of an opening according to a illustrative embodiment of the present invention.
Figure 7:
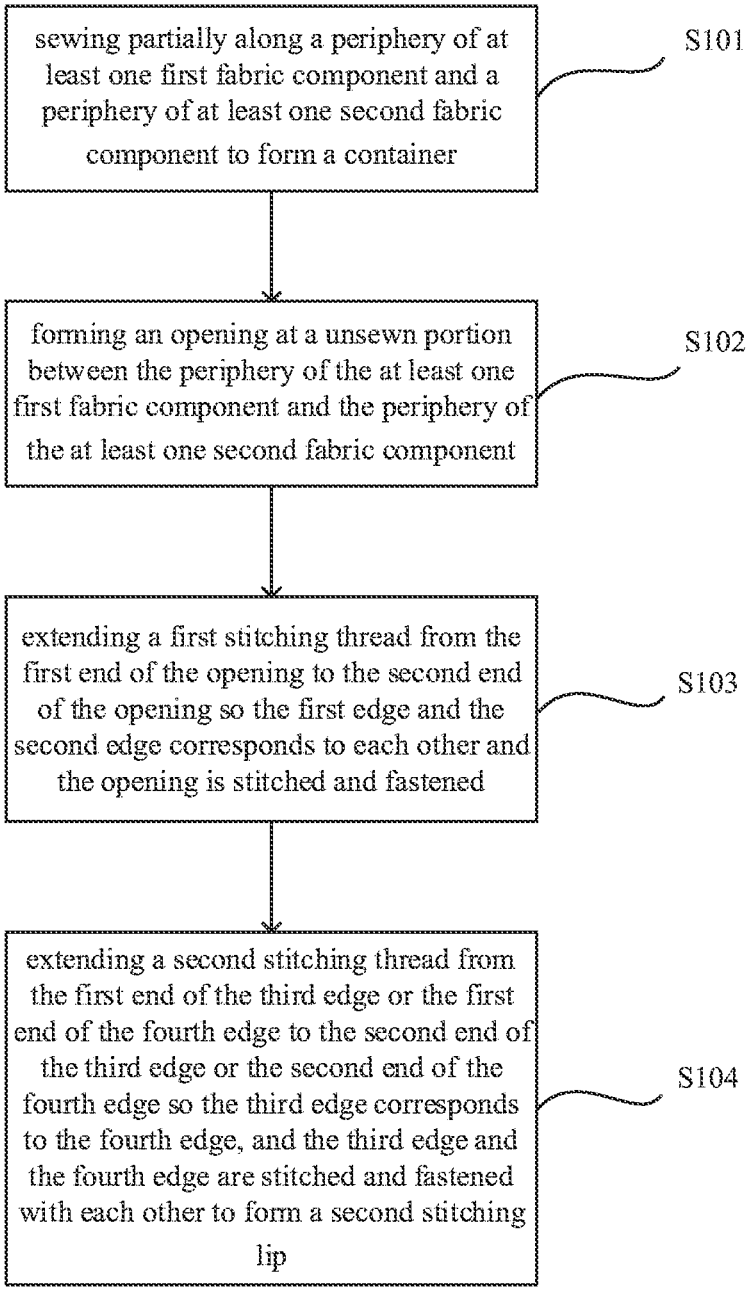
FIG. 7 illustrates a flow diagram of a sewing method according to a illustrative embodiment of the present invention.

Please refer to FIG. 1. FIG. 1 illustrates a structural schematic view of a illustrative embodiment of the present invention to show the structure of the stuffed object which is not sewn by a first stitching thread and a second stitching thread. An outer layer structure of a stuffed object and a sewing method thereof according to the present invention could be applied to the stuffed toys. As shown in FIG. 1, the stuffed toy comprises a first fabric component 11 and a second fabric component 12. It needs to say specifically that the stuffed toy could comprise a plurality of first fabric components 11 or a plurality of second fabric components 12 in other embodiments. A container 1 is formed by sewing partially along a periphery of the first fabric component 11 and a periphery of the second fabric component 12 to fasten to each other substantially (S101, as shown in FIG. 7). In this embodiment, the container 1 is a main body of the stuffed toy. A container 1 has an accommodation space 10 inside the container 1 and the accommodation space 10 cloud be filled by cotton, cotton fabrics, polyester fiber fillers, particles of various materials, voiced paper, air bags which could be pressed for sound, air bags which could be pressed for silent, motional air bags, dynamic air bags (not shown in the drawings), etc. In this embodiment, a predetermined shape is defined by an outer surface of the container 1. As shown in FIG. 1, the outer surface of the container 1 could be the various shapes of animals, plants or insects, but not limited thereto.

The container 1 further comprises an opening 2 connected with the accommodation space 10 so the fillers are easy to be stuffed into the accommodation space 10 through the opening 2 by manufacturing people or machine equipment of stuffed toys. In a better embodiment, the opening 2 could make the fillers enter the container 1 and connect with the accommodation space 10.

Figure 2:
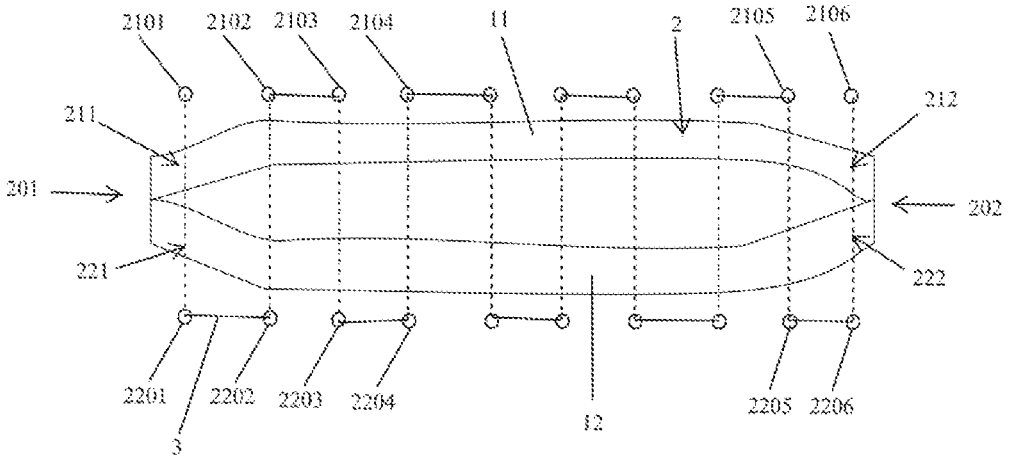
FIG. 2 illustrates a structural schematic view of inputting/outputting needle points used for a first stitching thread according to a illustrative embodiment of the present invention.

Please refer to FIG. 1 and FIG. 2 together. The opening 2 further may comprise a first edge 21 and a second edge 22. The first edge 21 may be located on a side of the first fabric component 11 and have a first end 211 and a second end 212. The second edge 22 may be located on a side of the second fabric component 12 and have a first end 221 and a second end 222. In this embodiment, the opening 2 is formed by the second edge 22 and the corresponding first edge 21 (S102, as shown in FIG. 7). As shown in FIG. 2, in this embodiment, the opening 2 further may have a first end 201 and a second end 202. The first end 211 of the first edge 21 corresponds to the first end 221 of the second edge 22 and the first end 201 of the opening 2 is formed by fastening the first end 211 of the first edge 21 to the first end 221 of the second edge 22. The second end 212 of the first edge 21 corresponds to the second end 222 of the second edge 22 and the second end 202 of the opening 2 is formed by fastening the second end 212 of the first edge 21 to the second end 222 of the second edge 22. In this embodiment, a thread could fasten the first end 211 of the first edge 21 to the corresponding first end 221 of the second edge 22 through machine sewing or hand sewing. In the same way, a thread could also fasten the second end 212 of the first edge 21 to the corresponding second end 222 of the second edge 22.

After the fillers are stuffed into the accommodation space 10 through the opening 2, it needs to stitch and seal the opening 2 by a first stitching thread 3 and a second stitching thread 4 in sequence to avoid the fillers disengagement or dropping out from the opening 2.

Figure 3:
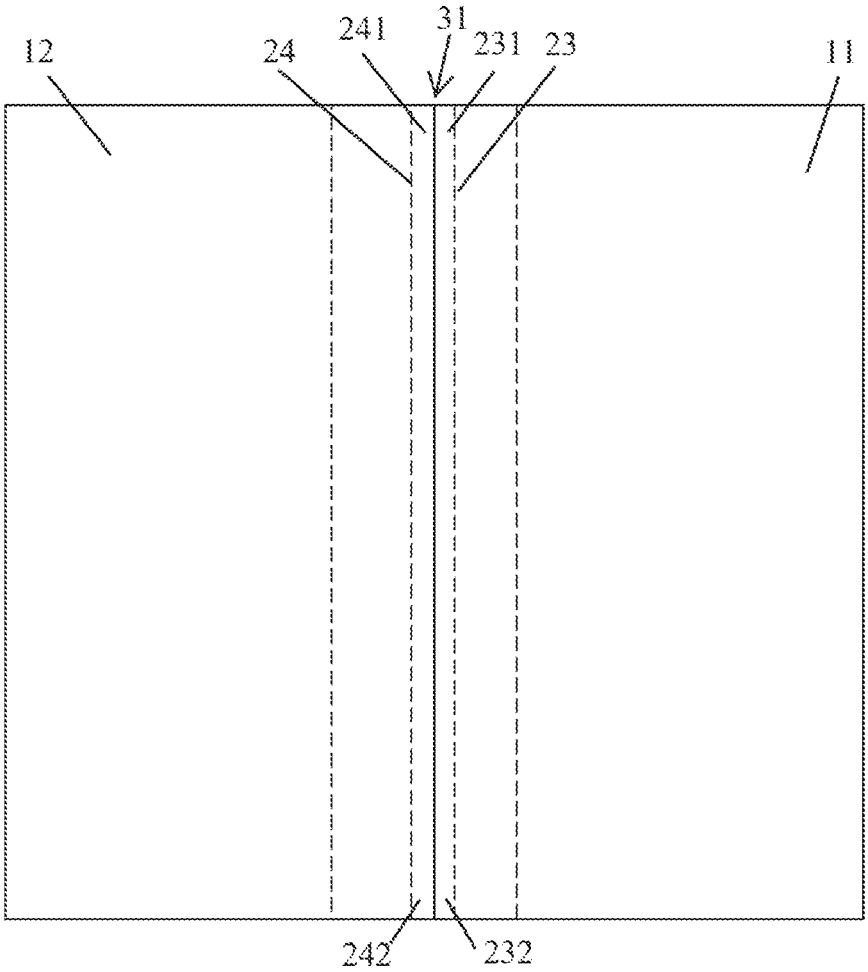
FIG. 3 illustrates a structural schematic view of formation of a first seam according to a illustrative embodiment of the present invention.

Please refer to FIG. 2. In more detail, in an embodiment of the present invention, the first stitching thread 3 could sequentially draw through the first inputting needle point 2101 of the first edge 21, the first outputting needle point 2201 of the second edge 22, the first inputting needle point 2202 of the second edge 22, the first outputting needle point 2102 of the first edge 21, the second inputting needle point 2103 of the first edge 21, the second outputting needle point 2203 of the second edge 22, the second inputting needle point 2204 of the second edge 22, the second outputting needle point 2104 of the first edge 21 and so on. Until the first stitching thread 3 sequentially draws through the n-th inputting needle point 2105 of the first edge 21, the m-th outputting needle point 2205 of the second edge 22, the m-th inputting needle point 2206 of the second edge 22, the n-th outputting needle point 2106 of the first edge 21, a first seam 31 shown in FIG. 3 is formed at the opening 2.

The multiple said inputting needle points and outputting needle points on the first edge 21 and the second edge 22 for the first stitching thread 3 to draw in sequence are summarized into the following order of arrangement. Namely, the first edge 21 comprises the n-th inputting needle point and the n-th outputting needle point, wherein n may be a positive integer greater than 0, and the second edge 22 comprises the m-th inputting needle point and the m-th outputting needle point, wherein m may be a positive integer greater than 0, wherein when n is equal to m, the n-th inputting needle point of the first edge 21 corresponds to the m-th outputting needle point of the second edge 22 and the m-th inputting needle point of the second edge 22 corresponds to the n-th outputting needle point of the first edge 21.

In a better embodiment, the n-th inputting needle point and the n-th outputting needle point of the first edge 21 are interlaced and intervallic arranged with each other, wherein n may be a positive integer greater than 0 and the first inputting needle point of the first edge 21 is near outside or inside of the first end of the first edge 21. Relatively, in this embodiment, the m-th inputting needle point and the m-th outputting needle point of the second edge 22 are interlaced and intervallic arranged with each other, wherein m may be a positive integer greater than 0 and the first outputting needle point of the second edge 22 is near outside or inside of the first end of the second edge 22.

As mentioned above, by using said structure of the multiple inputting needle points and outputting needle points on the first edge 21 and the second edge 22 and the first stitching thread 3, the first stitching thread 3 is extended from the first end 211 of the first edge 21, or the outside or inside of the first end 211, or the first end 221 of the second edge 22, or the outside or inside of the first end 221 to the second end 212 of the first edge 21, or the outside or inside of the second end 212, or the second end 222 of the second edge 22, or the outside or inside of the second end 222 so the first edge 21 and the second edge 22 correspond and are fastened to each other to form the first seam 31 (S103, as shown in FIG. 7)

In a better embodiment, the vertical distance between the first stitching thread 3 and the first edge 21 or the second edge 22 may be between 1 mm and 5 mm, but not limited thereto. The vertical distance between the first stitching thread 3 and the first edge 21 or the second edge 22 could be adjusted according to actual requirements.

In a better embodiment, the distance between the n-th inputting needle point of the first edge 21 and the n-th outputting needle point of the first edge 21 may be between 1 mm and 5 mm, but not limited thereto. The distance between the n-th inputting needle point of the first edge 21 and the n-th outputting needle point of the first edge 21 could be adjusted according to actual requirements.

In a better embodiment, the distance between the m-th inputting needle point of the second edge 22 and the m-th outputting needle point of the second edge 22 may be between 1 mm and 5 mm, but not limited thereto. The distance between the m-th inputting needle point of the second edge 22 and the m-th outputting needle point of the second edge 22 could be adjusted according to actual requirements.

In an embodiment of the present invention, the first seam 31 further comprises a third edge 23 and a fourth edge 24. The third edge 23 may be located on the first fabric component 11 near the first edge 21 and have a first end 231 and a second end 232. In a better embodiment, the third edge 23 may be substantially parallel to the first edge 21, but not limited thereto. The fourth edge 24 may be located on the second fabric component 12 near the second edge 22 and have a first end 241 and a second end 242. In a better embodiment, the fourth edge 24 may be substantially parallel to the second edge 22, but not limited thereto. In a best embodiment, the fourth edge 24 corresponds to the third edge 23.

Figure 4:
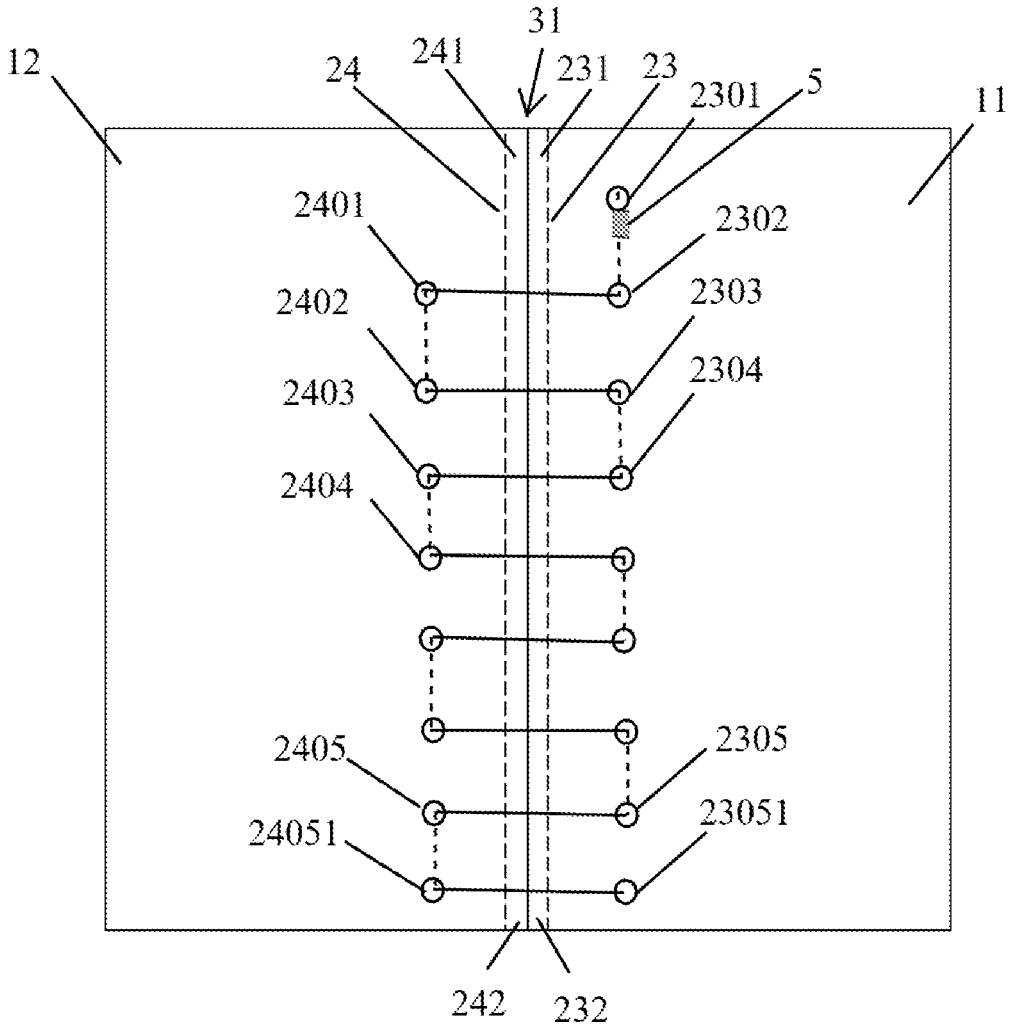
FIG. 4 illustrates a structural schematic view of inputting/outputting needle points used for a second stitching thread according to a illustrative embodiment of the present invention.

Please refer to FIG. 4. In this embodiment, the second stitching thread 4 could sequentially draw through the first inputting needle point 2301 of the third edge 23, the first outputting needle point 2302 of the third edge 23, the first inputting needle point 2401 of the fourth edge 24, the first outputting needle point 2402 of the fourth edge 24, the second inputting needle point 2303 of the third edge 23, the second outputting needle point 2304 of the third edge 23, the second inputting needle point 2403 of the fourth edge 24, the second outputting needle point 2404 of the fourth edge 24 and so on, until the p-th outputting needle point 2305 of the third edge 23.

The multiple said inputting needle points and outputting needle points on the third edge 23 and the fourth edge 24 for the second stitching thread 4 to draw in sequence are summarized into the following order of arrangement. Namely, the third edge 23 comprises the p-th inputting needle point and the p-th outputting needle point, wherein p may be a positive integer greater than 0, and the fourth edge 24 comprises the q-th inputting needle point and the q-th outputting needle point, wherein q may be a positive integer greater than 0. In this embodiment, when p is equal to q, the p-th outputting needle point of the third edge 23 corresponds to the q-th inputting needle point of the fourth edge 24 and the q-th outputting needle point of the fourth edge 24 corresponds to the (p+1)-th inputting needle point 23051 of the third edge 23 and so on.

In a better embodiment, the p-th inputting needle point and the p-th outputting needle point of the third edge 23 are interlaced and intervallic arranged with each other, wherein p may be a positive integer greater than 0 and the first inputting needle point of the third edge 23 is near outside or inside of the first end of the third edge 23. In another better embodiment, the q-th inputting needle point and the q-th outputting needle point of the fourth edge 24 are interlaced and intervallic arranged with each other, wherein q may be a positive integer greater than 0 and the first inputting needle point of the fourth edge 24 is near outside or inside of the first end of the fourth edge 24.

Figure 5:
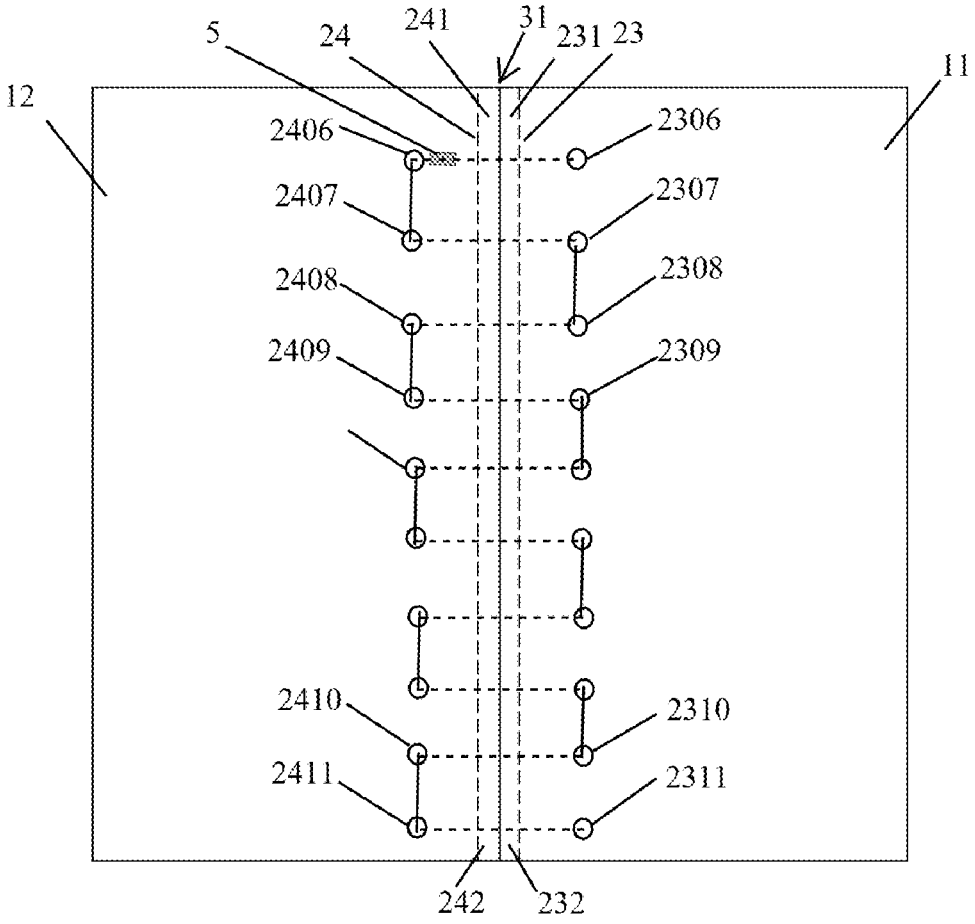
FIG. 5 illustrates a structural schematic view of inputting/outputting needle points used for a second stitching thread according to another illustrative embodiment of the present invention.

Please refer to FIG. 5. In another embodiment, the structure of the multiple inputting needle points and outputting needle points on the third edge 23 and the fourth edge 24 and the needle drawing order of the second stitching thread 4 could follow the structure of the multiple inputting needle points and outputting needle points on the first edge 21 and the second edge 22 and the needle drawing order of the first stitching thread 3.

Figure 6:
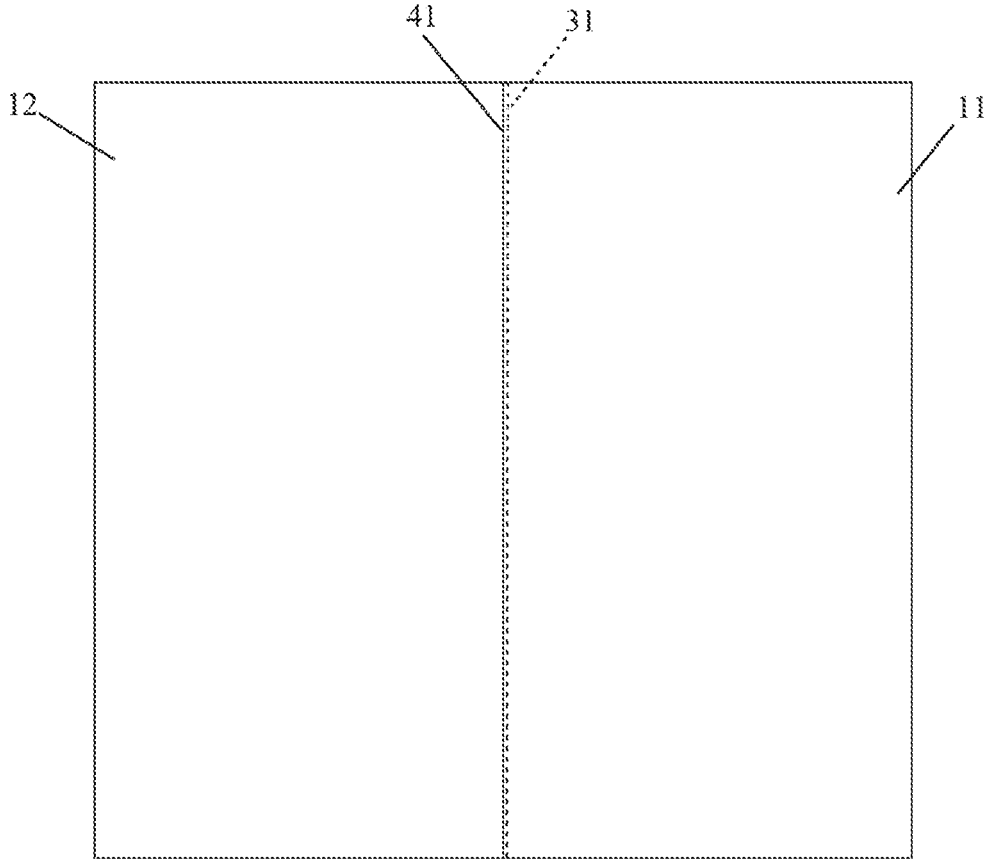
FIG. 6 illustrates a structural schematic view of formation of a second seam according to a illustrative embodiment of the present invention.

More specifically, the second stitching thread 4 could sequentially draw through the first inputting needle point 2306 of the third edge 23, the first outputting needle point 2406 of the fourth edge 24, the first inputting needle point 2407 of the fourth edge 24, the first outputting needle point 2307 of the third edge 23, the second inputting needle point 2308 of the third edge 23, the second outputting needle point 2408 of the fourth edge 24, the second inputting needle point 2409 of the fourth edge 24, the second outputting needle point 2309 of the third edge 23 and so on. Until the second stitching thread 4 sequentially draws through the p-th inputting needle point 2310 of the third edge 23, the q-th outputting needle point 2410 of the fourth edge 24, the q-th inputting needle point 2411 of the fourth edge 24, the p-th outputting needle point 2311 of the third edge 23, a second seam 41 shown in FIG. 6 is formed at the opening 2 (S104, as shown in FIG. 7).

The multiple said inputting needle points and outputting needle points on the third edge 23 and the fourth edge 24 for the second stitching thread 4 to draw in sequence are summarized into the following order of arrangement. Namely, the third edge 23 comprises the p-th inputting needle point and the p-th outputting needle point, wherein p may be a positive integer greater than 0, and the fourth edge 24 comprises the q-th inputting needle point and the q-th outputting needle point, wherein q may be a positive integer greater than 0, wherein when p is equal to q, the p-th inputting needle point of the third edge 23 corresponds to the q-th outputting needle point of the fourth edge 24 and the q-th inputting needle point of the fourth edge 24 corresponds to the p-th outputting needle point of the third edge 23.

In a better embodiment, the p-th inputting needle point and the p-th outputting needle point of the third edge 23 are interlaced and intervallic arranged with each other, wherein p may be a positive integer greater than 0 and the first inputting needle point of the third edge 23 is near outside or inside of the first end of the third edge 23. Relatively, in this embodiment, the q-th inputting needle point and the q-th outputting needle point of the fourth edge 24 are interlaced and intervallic arranged with each other, wherein q may be a positive integer greater than 0 and the first inputting needle point of the fourth edge 24 is near outside or inside of the first end of the fourth edge 24.

As mentioned above, by using said two structures of the multiple inputting needle points and outputting needle points on the third edge 23 and the fourth edge 24 and the second stitching thread 4, the second stitching thread 4 is extended from the first end 231 of the third edge 23, or the outside or inside of the first end 231, or the first end 241 of the fourth edge 24, or the outside or inside of the first end 241 to the second end 232 of the third edge 23, or the outside or inside of the second end 232, or the second end 242 of the fourth edge 24, or the outside or inside of the second end 242 so the third edge 23 and the fourth edge 24 correspond and are fastened to each other to form the second seam 41 (S104, as shown in FIG. 7).

In a better embodiment, the vertical distance between the second stitching thread 4 and the third edge 23 or the fourth edge 24 may be between 1 mm and 5 mm, but not limited thereto. The vertical distance between the second stitching thread 4 and the third edge 23 or the fourth edge 24 could be adjusted according to actual requirements.

In a better embodiment, the distance between the p-th inputting needle point of the third edge 23 and the p-th outputting needle point of the third edge 23 may be between 1 mm and 5 mm, but not limited thereto. The distance between the p-th inputting needle point of the third edge 23 and the p-th outputting needle point of the third edge 23 could be adjusted according to actual requirements.

In a better embodiment, the distance between the q-th inputting needle point of the fourth edge 24 and the q-th outputting needle point of the fourth edge 24 may be between 1 mm and 5 mm, but not limited thereto. The distance between the q-th inputting needle point of the fourth edge 24 and the q-th outputting needle point of the fourth edge 24 could be adjusted according to actual requirements.

According to the each embodiment mentioned above, the second stitching thread further forms a bar-tack structure 5 between the first outputting needle point of the third edge and the first inputting needle point of the fourth edge or between the first inputting needle point of the third edge and the first outputting needle point of the fourth edge.

According to an actual test, the stuffed object made by using the outer layer structure of the stuffed object and the sewing method thereof according to the present invention is clamped on both sides of the first seam and the second seam respectively by two needle nose pliers of a tension puller, which is about 2 cm away from the first seam and the second seam. One side of the stuffed object hangs on the tension puller, and another side of the stuffed object is pulled in parallel. The pulling force reaches 36.3 kg (about 80 pounds) and stays for 10 seconds. The test result shows that both of the first seam and the second seam are not broken or damaged. By comparison, the seam of the stuffed object made by using the structures and the sewing methods thereof in the prior art is torn when the pulling force is less than 30 kg (about 62 pounds). In summary, the stuffed object made by using the outer layer structure of the stuffed object and the sewing method thereof according to the present invention are able to increase the strength at the stitching positions of the stuffed object to enhance the durability of the stuffed object. In addition to being entertaining for humans, the stuffed object applying the present invention are more suitable for pets, such as dogs or cats, based on the great tolerance of biting and pulling.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the appended claims.

What is claimed is:

1. An outer layer structure of a stuffed object, comprising:

at least one first fabric component and at least one second fabric component fastened to each other substantially to form a container which has an accommodation space inside the container and a predetermined shape is defined by an outer surface of the container; the container further comprises an opening connected with the accommodation space, wherein the opening comprises:

a first edge located on a side of the first fabric component and having a first end and a second end; and a second edge located on a side of the second fabric component and having a first end and a second end, and the second edge corresponds to the first edge to form the opening, wherein the opening has a first end and a second end; the first and second edges being arranged opposite each other along a first reference direction so as to define the opening; wherein the first end of the first edge corresponds to the first end of the second edge and the first end of the opening is formed by fastening the first end of the first edge to the first end of the second edge, and the second end of the first edge corresponds to the second end of the second edge and the second end of the opening is formed by fastening the second end of the first edge to the second end of the second edge;

a first stitching thread passed repeatedly between the first and second edges so as to form a set of first stitch segments that are exposed on an outer surface of the first and second edges and extend from the first end of the opening to the second end of the opening, wherein the first stitch segments extend generally along the first reference direction, so the first edge and the second edge correspond to each other and the opening is stitched and fastened by the first stitching thread, and thereby a first seam defined by the first stitch segments, wherein the first seam further defines:

a third edge located on the first fabric component near the first edge and having a first end and a second end; and a fourth edge located on the second fabric component near the second edge and having a first end and a second end, and the fourth edge corresponds to the third edge, wherein the first end of the third edge corresponds to the first end of the fourth edge, and the first end of the third edge and the first end of the fourth edge are fastened to each other, and the second end of the third edge corresponds to the second end of the fourth edge, and the second end of the third edge and the second end of the fourth edge are fastened to each other; and a second stitching thread passed repeatedly between the third and fourth edges so as to form a set of second stitch segments that are exposed on an outer surface of the third and fourth edges and extend from the first end of the third edge or the first end of the fourth edge to the second end of the third edge or the second end of the fourth edge, so the third edge corresponds to the fourth edge, wherein the second stitch segments are along a second reference direction which is substantially perpendicular to the first reference direction, and the third edge and the fourth edge are stitched and fastened to each other to define a second seam.

2. The outer layer structure of a stuffed object of claim 1, wherein the first edge comprises an n-th inputting needle point and an n-th outputting needle point, wherein n is a positive integer greater than 0, and the second edge comprises an m-th inputting needle point and an m-th outputting needle point, wherein m is a positive integer greater than 0, wherein when n is equal to m, the n-th inputting needle point of the first edge corresponds to the m-th outputting needle point of the second edge and the m-th inputting needle point of the second edge corresponds to the n-th outputting needle point of the first edge.

3. The outer layer structure of a stuffed object of claim 2, wherein the n-th inputting needle point and the n-th outputting needle point of the first edge are interlaced and intervallic arranged with each other, wherein n is a positive integer greater than 0 and a first inputting needle point of the first edge is near the first end of the first edge.

4. The outer layer structure of a stuffed object of claim 3, wherein the m-th inputting needle point and the m-th outputting needle point of the second edge are interlaced and intervallic arranged with each other, wherein m is a positive integer greater than 0 and a first outputting needle point of the second edge is near the first end of the second edge.

5. The outer layer structure of a stuffed object of claim 4, wherein the first stitching thread sequentially draws through the first inputting needle point of the first edge, the first outputting needle point of the second edge, the first inputting needle point of the second edge, the first outputting needle point of the first edge, the second inputting needle point of the first edge, the second outputting needle point of the second edge, the second inputting needle point of the second edge, the second outputting needle point of the first edge, the n-th inputting needle point of the first edge, the m-th outputting needle point of the second edge, the m-th inputting needle point of the second edge, the n-th outputting needle point of the first edge, wherein n is a positive integer greater than 2 and m is a positive integer greater than 2.

6. The outer layer structure of a stuffed object of claim 5, wherein the third edge comprises a p-th inputting needle point and a p-th outputting needle point, wherein p is a positive integer greater than 0, and the fourth edge comprises a q-th inputting needle point and a q-th outputting needle point, wherein q is a positive integer greater than 0, wherein when p is equal to q, the p-th outputting needle point of the third edge corresponds to the q-th inputting needle point of the fourth edge and the q-th outputting needle point of the fourth edge corresponds to the (p+1)-th inputting needle point of the third edge.

7. The outer layer structure of a stuffed object of claim 6, wherein the p-th inputting needle point and the p-th outputting needle point of the third edge are interlaced and intervallic arranged with each other, wherein p is a positive integer greater than 0 and a first inputting needle point of the third edge is near the first end of the third edge.

8. The outer layer structure of a stuffed object of claim 7, wherein the q-th inputting needle point and the q-th outputting needle point of the fourth edge are interlaced and intervallic arranged with each other, wherein q is a positive integer greater than 0 and a first inputting needle point of the fourth edge is near the first end of the fourth edge.

9. The outer layer structure of a stuffed object of claim 8, wherein the second stitching thread sequentially draws through the first inputting needle point of the third edge, the first outputting needle point of the third edge, the first inputting needle point of the fourth edge, the first outputting needle point of the fourth edge, the second inputting needle point of the third edge, the second outputting needle point of the third edge, the second inputting needle point of the fourth edge, the second outputting needle point of the fourth edge, the p-th outputting needle point of the third edge, wherein p is a positive integer greater than 2.

10. The outer layer structure of a stuffed object of claim 9, wherein after the second stitching thread sequentially draws through the p-th outputting needle point of the third edge, the second stitching thread draws through the q-th inputting needle point of the fourth edge, and then draws through the q-th outputting needle point of the fourth edge, wherein p is a positive integer greater than 2 and q is a positive integer greater than 2.

11. The outer layer structure of a stuffed object of claim 3, wherein the distance between the n-th inputting needle point of the first edge and the n-th outputting needle point of the first edge is between 1 mm and 5 mm.

12. The outer layer structure of a stuffed object of claim 4, wherein the distance between the m-th inputting needle point of the second edge and the m-th outputting needle point of the second edge is between 1 mm and 5 mm.

13. The outer layer structure of a stuffed object of claim 5, wherein the third edge comprises a p-th inputting needle point and a p-th outputting needle point, wherein p is a positive integer greater than 0, and the fourth edge comprises a q-th inputting needle point and a q-th outputting needle point, wherein q is a positive integer greater than 0, wherein when p is equal to q, the p-th inputting needle point of the third edge corresponds to the q-th outputting needle point of the fourth edge and the q-th inputting needle point of the fourth edge corresponds to the p-th outputting needle point of the third edge.

14. The outer layer structure of a stuffed object of claim 13, wherein the p-th inputting needle point and the p-th outputting needle point of the third edge are interlaced and intervallic arranged with each other, wherein p is a positive integer greater than 0 and a first inputting needle point of the third edge is near the first end of the third edge.

15. The outer layer structure of a stuffed object of claim 14, wherein the q-th inputting needle point and the q-th outputting needle point of the fourth edge are interlaced and intervallic arranged with each other, wherein q is a positive integer greater than 0 and a first outputting needle point of the fourth edge is near the first end of the fourth edge.

16. The outer layer structure of a stuffed object of claim 13, wherein the second stitching thread sequentially draws through the first inputting needle point of the third edge, the first outputting needle point of the fourth edge, the first inputting needle point of the fourth edge, the first outputting needle point of the third edge, the second inputting needle point of the third edge, the second outputting needle point of the fourth edge, the second inputting needle point of the fourth edge, the second outputting needle point of the third edge, the p-th inputting needle point of the third edge, the q-th outputting needle point of the fourth edge, the q-th inputting needle point of the fourth edge, the p-th outputting needle point of the third edge, wherein p is a positive integer greater than 2 and q is a positive integer greater than 2.

17. The outer layer structure of a stuffed object of claim 16, wherein the second stitching thread further forms a bar-tack structure between the first outputting needle point of the fourth edge and the first inputting needle point of the fourth edge.

18. The outer layer structure of a stuffed object of claim 1, wherein the vertical distance between the first stitching thread and the first edge or the second edge is between 1 mm and 5 mm.

19. The outer layer structure of a stuffed object of claim 1, wherein the vertical distance between the second stitching thread and the third edge or the fourth edge is between 1 mm and 5 mm.

20. A sewing method of an outer layer structure of a stuffed object, comprising:

sewing partially along a periphery of at least one first fabric component and a periphery of at least one second fabric component to form a container which has an accommodation space inside the container;

forming an opening at a unsewn portion between the periphery of the at least one first fabric component and the periphery of the at least one second fabric component, wherein the opening is connected with the accommodation space and the opening comprises a first edge and a second edge, wherein the first edge is located on a side of the first fabric component and has a first end and a second end; and the second edge is located on a side of the second fabric component and has a first end and a second end, the first and second edges being arranged opposite each other along a first reference direction so as to define the opening;

extending a first stitching thread repeatedly from the first end of the opening to the second end of the opening and between the first and second edges so as to form a set of first stitch segments that are exposed on an outer surface of the first and second edges that extend generally along the first reference direction, and thereby a first seam defined by the first stitch segments, wherein the first seam further defines a third edge and a fourth edge, wherein the third edge is located on the first fabric component near the first edge and has a first end and a second end, wherein the third edge is substantially parallel to the first edge; and the fourth edge is located on the second fabric component near the second edge and has a first end and a second end, wherein the fourth edge is substantially parallel to the second edge and the fourth edge corresponds to the third edge; and extending a second stitching thread repeatedly from the first end of the third edge or the first end of the fourth edge to the second end of the third edge or the second end of the fourth edge so the third edge corresponds to the fourth edge and between the third and fourth edges so as to form a set of second stitch segments that are exposed on an outer surface of the third and fourth edges, wherein the second stitch segments are along a second reference direction which is substantially perpendicular to the first reference direction, and the third edge and the fourth edge are stitched and fastened to each other to define a second seam.

* * * * *